US011325773B2

(12) United States Patent
Chaney et al.

(10) Patent No.: US 11,325,773 B2
(45) Date of Patent: May 10, 2022

(54) SPRAY CANISTER DISPENSER

(71) Applicants: Jeffery Jay Chaney, Terrell, TX (US); Craig Self, Rockwall, TX (US)

(72) Inventors: Jeffery Jay Chaney, Terrell, TX (US); Craig Self, Rockwall, TX (US)

( * ) Notice: Subject to any disclaimer, the term of this patent is extended or adjusted under 35 U.S.C. 154(b) by 0 days.

(21) Appl. No.: 17/365,407

(22) Filed: Jul. 1, 2021

(65) Prior Publication Data

US 2022/0024678 A1 Jan. 27, 2022

Related U.S. Application Data

(60) Provisional application No. 63/056,977, filed on Jul. 27, 2020.

(51) Int. Cl.
*B65D 83/16* (2006.01)
*B65D 83/20* (2006.01)
*B05B 11/00* (2006.01)

(52) U.S. Cl.
CPC ..... *B65D 83/206* (2013.01); *B05B 11/0005* (2013.01)

(58) Field of Classification Search
CPC .... B65D 83/22; B65D 83/203; B65D 83/202; B65D 83/208; B65D 83/206; B65D 11/0005; B65D 11/007; B65D 11/0072; B65D 11/0094; B65D 11/3052; B65D 11/3056; B65D 33/3057
USPC ..... 222/174, 402.15, 473, 402.13
See application file for complete search history.

(56) References Cited

U.S. PATENT DOCUMENTS 2,808,285 A * 10/1957 Robuck ..... A47J 45/078 294/29
3,045,878 A * 7/1962 Blanford ..... B65D 83/202 222/473
3,659,791 A * 5/1972 Clark ..... B65D 83/202 239/375
4,040,543 A * 8/1977 Guillen ..... B65D 83/202 222/473
4,089,440 A * 5/1978 Lee ..... B65D 83/202 222/174

(Continued)

FOREIGN PATENT DOCUMENTS

IT FI20090111 A1 11/2010
JP 2014037268 A 2/2014

*Primary Examiner* — Charles P. Cheyney
(74) *Attorney, Agent, or Firm* — Argus Intellectual Enterprise; Jordan Sworen; Daniel Enea

(57) ABSTRACT

A spray canister dispenser for mounting to a spray canister to allow for more convenient actuation of a nozzle. The spray canister dispenser includes a housing that removably mounts to an upper end of a spray canister. A first channel is disposed on an interior sidewall of the housing and can align with a lip of the spray canister to selectively couple thereto. An actuator assembly having a trigger handle and an actuator extends from a moveable plate secured to the housing and can transition between a dispensing and resting configuration. In the dispensing configuration, the actuator is forced against a spray canister nozzle to dispense substance therefrom. In use, the trigger handle is positioned on a forward side of the spray canister, wherein the housing is on a rearward side of the canister. An aperture is disposed within the trigger handle to allow the substance to be dispensed therethrough.

20 Claims, 9 Drawing Sheets

(56) References Cited

U.S. PATENT DOCUMENTS

| | | | | | |
|---|---|---|---|---|---|
| 4,886,191 | A * | 12/1989 | Yoshitomi | B65D 83/208 | 222/174 |
| 5,318,208 | A * | 6/1994 | van der Wal | B65D 83/262 | 222/402.13 |
| 5,904,273 | A * | 5/1999 | Aspacher | B65D 83/202 | 222/402.15 |
| 6,450,423 | B1 * | 9/2002 | Gurule | B65D 83/203 | 222/174 |
| 6,655,607 | B2 * | 12/2003 | Vazquez | B65D 83/206 | 239/288 |
| 7,631,785 | B2 | 12/2009 | Paas et al. | | |
| 7,686,193 | B1 | 3/2010 | Gervais et al. | | |
| 7,905,430 | B1 * | 3/2011 | Kumar | B65D 83/22 | 239/337 |
| 7,959,040 | B2 | 6/2011 | Heirman | | |
| 8,807,396 | B2 * | 8/2014 | Bodet | B65D 83/22 | 222/153.11 |
| 9,435,120 | B2 * | 9/2016 | Hanson | B65D 83/202 | |
| 10,358,280 | B2 | 7/2019 | Falcon et al. | | |
| 11,142,391 | B1 | 10/2021 | O'Brien et al. | | |
| 2003/0150876 | A1 | 8/2003 | Walters et al. | | |
| 2004/0222243 | A1 | 11/2004 | Sweeton | | |
| 2006/0113327 | A1 | 6/2006 | Walters et al. | | |
| 2008/0017673 | A1 | 1/2008 | Copps | | |
| 2011/0079617 | A1 | 4/2011 | Quarles et al. | | |
| 2011/0233235 | A1 | 9/2011 | Adams et al. | | |
| 2018/0015238 | A1 | 1/2018 | Schwab et al. | | |
| 2018/0099808 | A1 | 4/2018 | Richard et al. | | |

* cited by examiner

SPRAY CANISTER DISPENSER

CROSS REFERENCE TO RELATED APPLICATION

This application claims the benefit of U.S. Provisional Application No. 63/056,977 filed on Jul. 27, 2020. The above identified patent application is herein incorporated by reference in its entirety.

BACKGROUND OF THE INVENTION

The present invention relates to a spray canister dispenser. The present invention further provides a dispenser for easily dispensing substances from spray cans, spray bottles, spray canisters, or aerosol containers.

Common household liquids such as cleaning supplies, spray paint, and bug spray are dispensed in spray bottles. These containers require the user to press on the small nozzle or aerosol actuator to dispense the aerosol particles. Oftentimes, these actuators are uncomfortable to press, or the stream of particles is too weak to reach their desired destination.

There exist devices that can be attached to the top of spray bottles to aid in the dispensing of aerosol sprays. These devices are often found in the form of caps or levers that attach to the nozzle of the spray can. This allows the user to activate the spray can with the device instead of directly pressing the nozzle. However, these devices have many disadvantages. The devices are designed to attach to a spray can of a specific size or design and therefore fail to include any adjustment mechanism to allow them to fit different sized and designed spray cans. Due to the lack of adjustability, these devices must be installed within a close tolerance of the nozzle of the spray can to which it is attached to dispense properly. The proximity of installation to the nozzle can cause damage when both installing and removing the devices. If not handled carefully, the device can rip off the nozzle, rendering the spray can useless. Furthermore, these existing devices are uncomfortable to actuate and require excessive force to install and remove.

Furthermore, in use, a user continuously shakes the can to emulsify the propellant into the liquid. However, once these existing devices are installed, it is difficult for a user to naturally shake and use the spray can due to how the device is attached to the can and the positioning of the trigger. Therefore, there exists a need for a more versatile spray canister dispenser.

The present invention provides a spray canister dispenser that allows for multiple places of adjustability including how closely the dispenser is positioned over the nozzle and the diameter of the can in which it attaches. Moreover, this spray canister dispenser comprises a housing allowing for selective coupling of the aerosol actuator to the spray can. This device includes a trigger handle connected to a moveable plate within the housing. When the user presses the trigger handle towards the spray can, the moveable plate moves in unison to depress the aerosol actuator and release the contents therefrom. This device further allows for the moveable plate to be adjusted within the housing so as to attach to a variety of spray cans.

In light of the devices disclosed in the known art, it is submitted that the present invention substantially diverges in design elements and methods from the known art and consequently it is clear that there is a need in the art for an improvement for spray canister dispensers. In this regard the instant invention substantially fulfills these needs.

SUMMARY OF THE INVENTION

In view of the foregoing disadvantages inherent in the known types of spray canister dispensers now present in the known art, the present invention provides a new spray canister dispenser wherein the same can be attached to the top of a spray canister to ease the dispersal of an aerosol spray therefrom. Further, the present invention releases the aerosol spray when the lever is pressed toward the can.

It is an objective of the present invention to provide a spray canister device comprising a housing fitted to the lip on the lid of the canister. When mounted atop a canister, an actuator assembly is positioned over the aerosol actuator on the spray canister. When the trigger handle of the dispenser is compressed towards the can, the spray can actuator is compressed, and the aerosol spray is released.

It is an objective of the present invention to provide in some embodiments, a housing having a first channel and a second channel that are each adapted to align with and receive a lip of different sized spray cans.

It is also an objective of the present invention to provide an actuator assembly comprising an actuator operably connected to a trigger handle for dispensing the aerosol spray. The trigger handle is actuated by compressing it towards the body of the spray can. This causes the actuator to depress the aerosol actuator or nozzle and dispense the spray.

It is yet another objective of the present invention to provide an adjustment mechanism for attachment to different spray cans of various shapes and aerosol actuator positions.

It is therefore an object of the present invention to provide a new and improved spray canister dispenser that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for dispensing content from spray cans. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment. Additionally, "spray can", "spray canister", "aerosol canister", "spray bottle", "sprayer" and "canister" may be used interchangeably, and all refer to the type of device the present invention is adapted to mount. Additionally, "spray canister actuator", "aerosol actuator" and "nozzle" may be used interchangeably, and all refer to the type of device the present invention is adapted to mount. When referring to contents of the spray canister, "aerosol" and "contents" and "substance", and the like may be used interchangeably.

Figure 1:
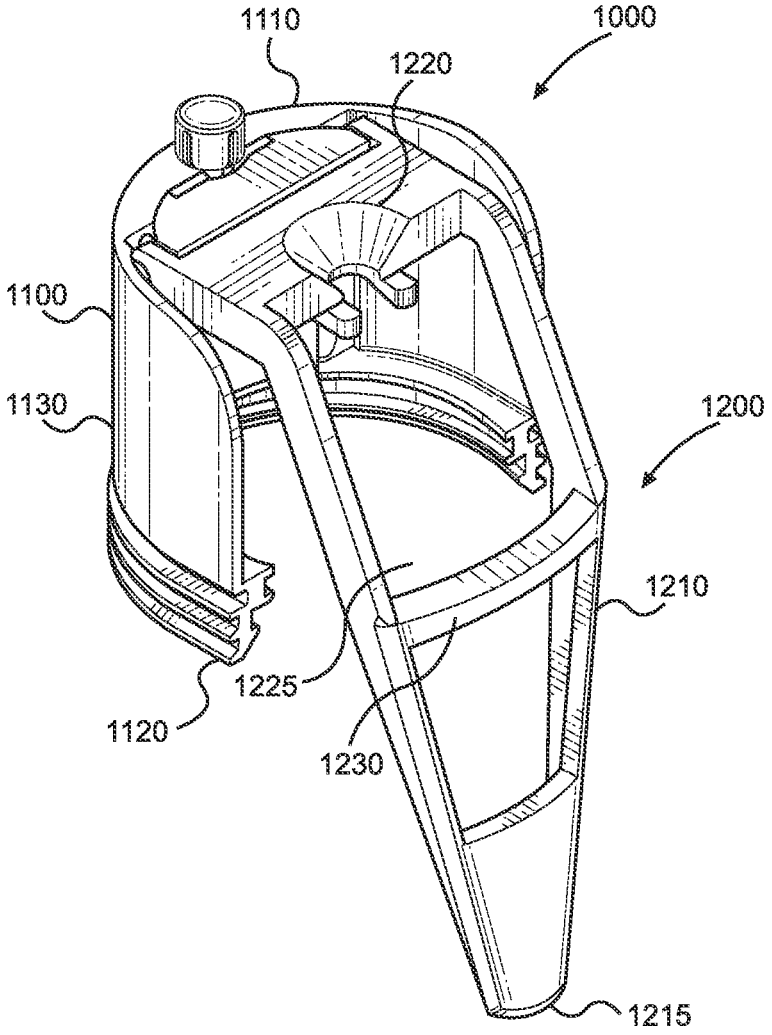
FIG. 1 shows a perspective view of an embodiment of the spray canister dispenser.
Figure 2:
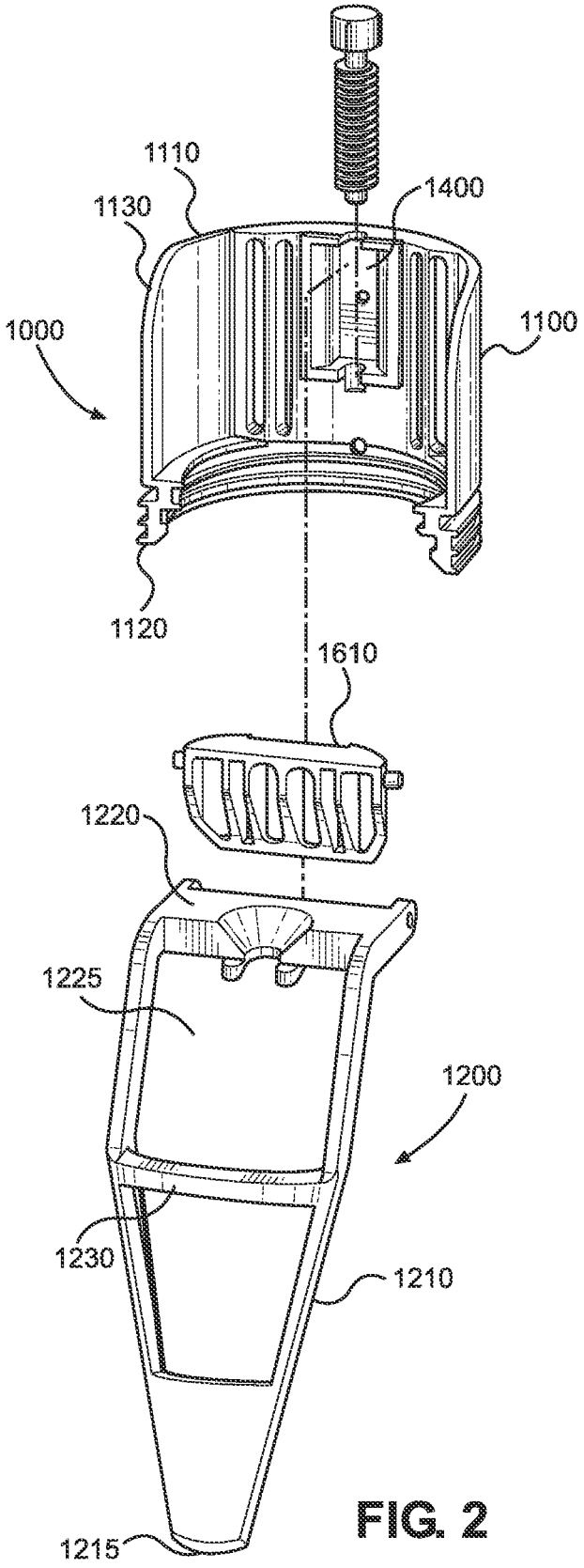
FIG. 2 shows an exploded view of an embodiment of the spray canister dispenser.

Referring now to FIGS. 1 and 2, there is shown a perspective view and an exploded view of an embodiment of the spray canister dispenser, respectively. The spray canister dispenser 1000 includes a housing 1100 configured to removably mount to an upper end of a spray canister. In the illustrated embodiment, the housing 1100 comprises a half sleeve having a curved sidewall 1130 extending between an upper end 1110 and lower end 1120. The lower end 1120 is open and curved for receiving a cylindrically shaped spray canister therein. In alternate embodiments, the housing 1100 comprises any suitable shape configured to receive a spray canister therein. The interior volume of the housing 1100 is substantially open so as to receive an upper end of the spray canister therein.

A spray canister is defined as a container having a dispensing system which dispenses contents thereof, such as creating a mist of liquid particles. In the illustrated embodiment, the spray canister comprises a dispensing system located at a top side of the container. In the illustrated embodiments, the present invention is adapted to receive and removably secure to various spray canisters having different circumferences or widths, as well as spray canisters having lips or no lips on an exterior edge thereof. Further, spray canisters on to which the present invention secures includes both aerosol sprayers and non-aerosol sprayers.

The spray canister dispenser 1000 further comprises an actuator assembly 1200 that extends from an interior side of the housing 1100. The actuator assembly 1200 comprises a trigger and an actuator 1220, wherein the actuator 1220 is configured to contact the spray canister nozzle to dispense the substance therefrom when force is applied to the trigger. The actuator assembly 1200 extends from the upper end of the housing 1100, wherein the actuator 1220 is adapted to be positioned over an actuator or nozzle of the spray canister. When the spray canister dispenser 1000 is mounted to the spray canister, the trigger is disposed on a forward side of the spray canister and the housing 1100 is disposed on a rearward side of the spray canister. The forward side of the spray canister indicates a direction the substance within the spray canister will be dispensed by the spray canister nozzle. The actuator assembly 1200 is configured to transition between a dispensing configuration and a resting configuration.

In the illustrated embodiment, the trigger is a trigger handle 1210 that extends substantially perpendicular to the actuator 1220 and away from the housing 1100. In the illustrated embodiment, the trigger handle 1210 extends from opposing sides of the housing 1100 and tapers downward in width. The tapered lower end 1215 of the trigger handle 1210 provides for more convenient and comfortable grasping by a hand of a user. In some embodiments, the lower end 1215 of the trigger handle 1210 is textured to allow a more convenient grasp by the user. In the illustrated embodiment, the trigger handle 1210 is biased away from the housing 1100 such that a user must move the handle 1210 towards the spray canister in order to actuate the spray canister nozzle. It is contemplated in other embodiments that the trigger handle is biased toward to the housing such that the user must move the handle away from the spray canister to actuate the nozzle.

The trigger handle 1210 comprises an aperture 1225 sized to allow for the substance to be dispensed therethrough since the trigger handle is adapted to be positioned on the forward side of the spray canister. In the illustrated embodiment, the trigger handle 1210 further comprises a brace 1230 extending between the lateral sides thereof to provide structural stability thereto and prevent the lateral sides of the trigger handle 1210 from deformation when the trigger receives force from the user.

Figure 3:
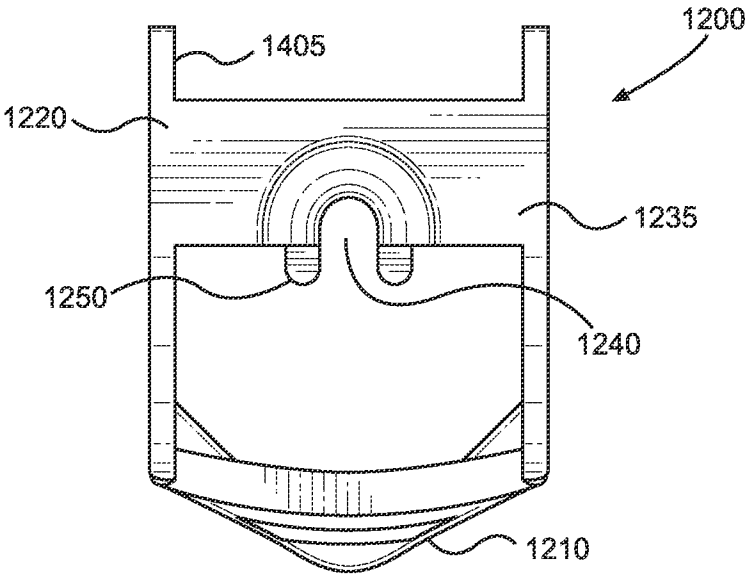
FIG. 3 shows a top planar view of the actuator assembly of the spray canister dispenser.

Referring now to FIG. 3, there is shown a top planar view of the actuator assembly of the spray canister dispenser. In the illustrated embodiment, the actuator 1220 extends from an upper side of the trigger. The actuator 1220 comprises a platform 1235 having a central U-shaped cutout 1240 and a pair of rails 1250 extending beneath the cutout 1240. The cutout 1240 allows the user to observe and confirm that the spray canister nozzle is properly positioned below the actuator 1220. A gap between the rails 1250 aligns with the cutout 1240, wherein the rails 1250 are configured to directly contact the top of the spray canister nozzle when the trigger handle 1210 is depressed. In alternate embodiments, the actuator 1220 does not have a cutout or a pair of rails disposed beneath the platform. Instead, the actuator 1220 comprises any suitable member extending from an upper end of the trigger handle and adapted to contact a spray canister nozzle when the trigger handle is depressed.

In the illustrated embodiment, the trigger handle 1210 and the actuator 1220 are formed of a monolithic structure. In some embodiments, the trigger handle and actuator are distinct structures. In the illustrated embodiment, the actuator assembly 1200 is formed of a rigid material.

Figure 4:
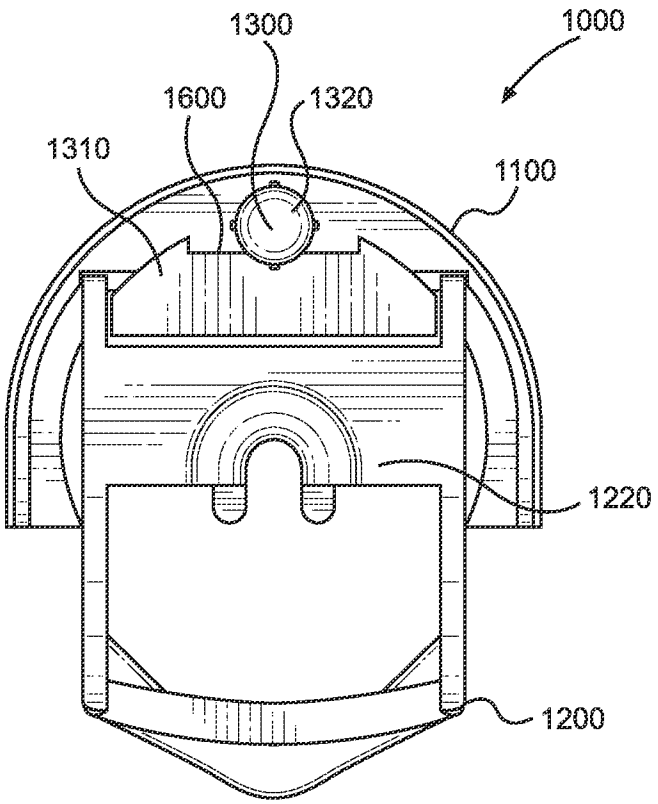
FIG. 4 shows a top planar view of an embodiment of the spray canister dispenser.
Figure 5:
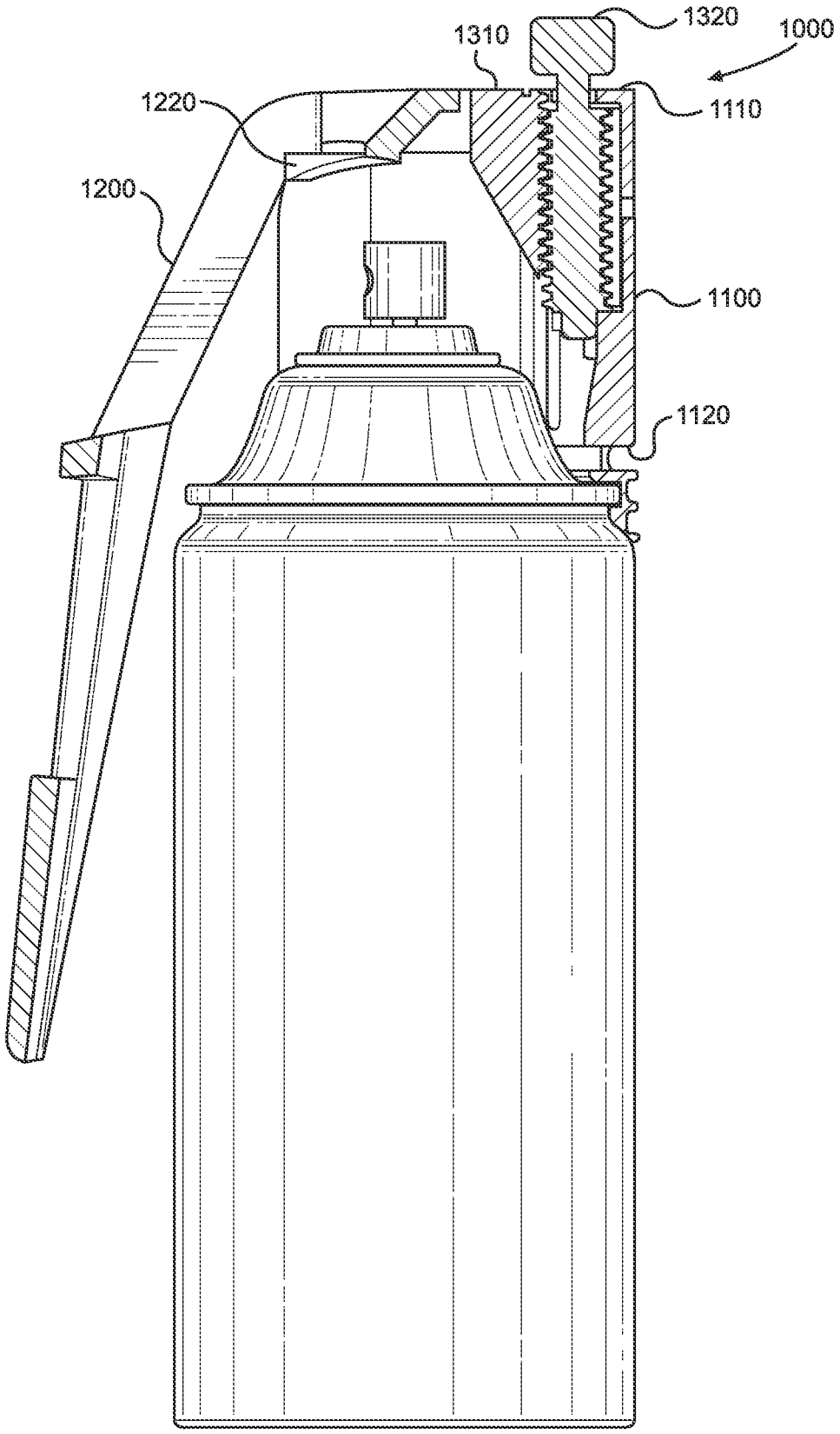
FIG. 5 shows a semi cross sectional view of an embodiment of the spray canister dispenser wherein the actuator assembly is in a first position.
Figure 6:
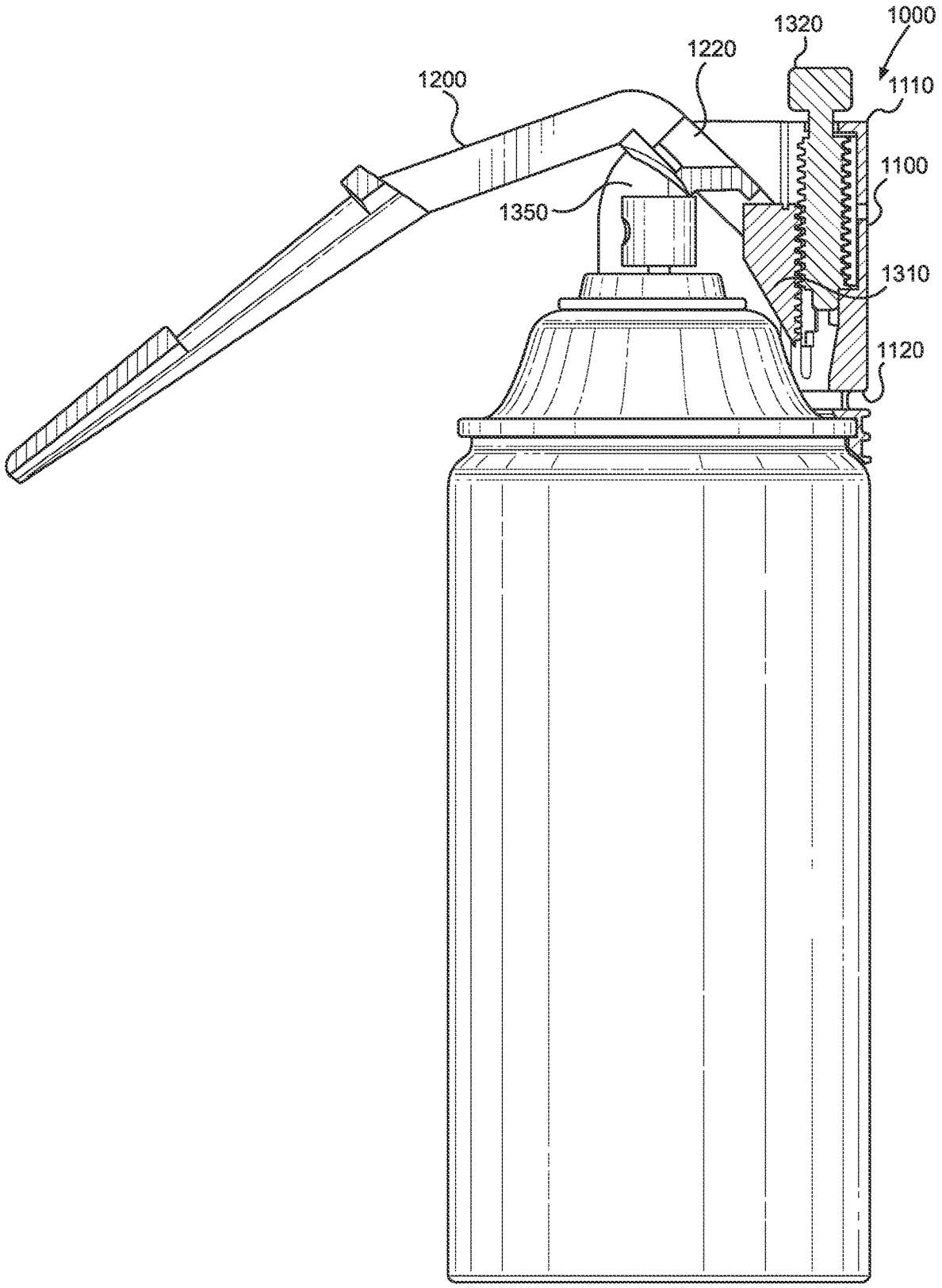
FIG. 6 shows a side perspective view of an embodiment of the spray canister dispenser wherein the actuator assembly is in a second position.

Referring now to FIGS. 4-6, there is shown top perspective view of an embodiment of the spray canister dispenser, a side perspective view of an embodiment of the spray canister dispenser wherein the actuator assembly is in a first position and a side perspective view of an embodiment of the spray canister dispenser wherein the actuator assembly is in a second position, respectively. In the illustrated embodiment, the spray canister dispenser 1000 further comprises an adjustment mechanism 1300 adapted to adjust a position of the actuator 1220 relative to the spray canister nozzle or nozzle. In the illustrated embodiment, the adjustment mechanism 1300 comprises a moveable plate 1310 and a threaded body 1320 rotatably coupled between the housing 1100 and the moveable plate 1310, such that as the threaded body 1320 is rotated the moveable plate 1310 moves along a longitudinal axis thereof causing the actuator assembly 1200 to move therewith. The actuator assembly 1200 is pivotally connected to the moveable plate 1310 of the adjustment assembly 1300 such that the trigger handle 1210 can be depressed while the adjustment assembly 1300 remains in a fixed position secured to the housing 1100.

The adjustment mechanism 1300 allows for the spray canister dispenser 1000 to be attached or used with many spray canisters having different shapes and actuator or nozzle positions. The adjustment mechanism 1300 allows the actuator 1220 to be selectively positioned over the spray canister nozzle such that the dispensing and resting configurations function as desired. The closer the movable plate 1310 is positioned toward the upper end 1110 of the housing 1100, the greater interior volume is provided within the housing 1100 to receive a spray canister, which can be seen in FIGS. 3 and 5 as a first position. However, some spray canisters when attached to the housing 1100 are too short such that the nozzle of the spray canister is unable to contact the actuator 1220 of the actuator assembly 1200. As a solution, the movable plate 1310 is lowered by rotating the threaded body 1320 as needed to the lower end 1120 of the housing 1100, which can be seen in FIG. 4 as a second position. The moveable plate 1310 is lowered until the actuator 1220 is able to contact the nozzle in the dispensing configuration.

In the dispensing configuration, the trigger handle 1210 is actuated by moving it towards the body of the spray canister, thereby causing the actuator 1220 to depress and bear against the spray canister nozzle causing the misted substance to be dispensed. In the resting configuration, the trigger handle 1210 is not actuated or depressed, and the actuator 1220 forms a separation or gap 1350 from the spray canister nozzle. In one embodiment, the trigger handle 1210 is biased away from the spray canister body in the resting configuration.

Figure 7:
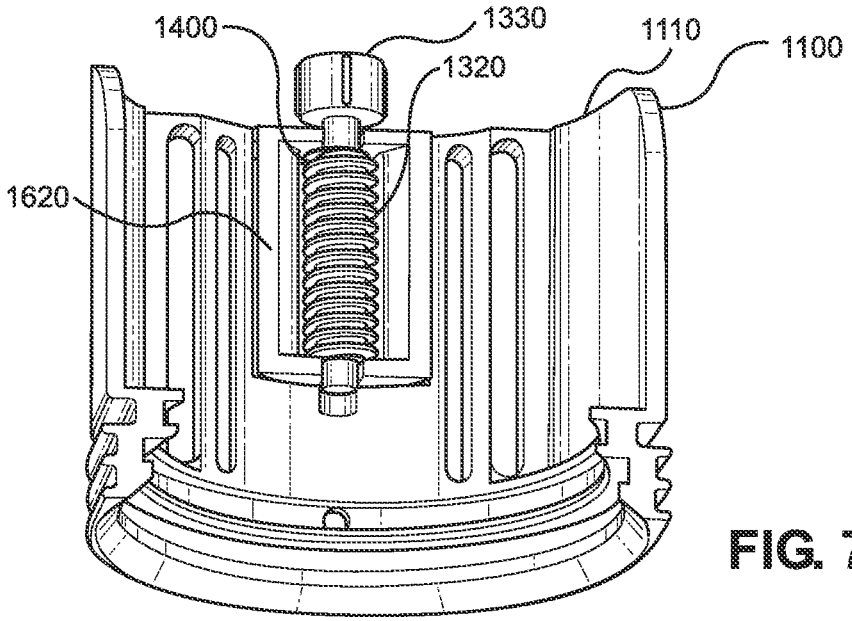
FIG. 7 shows a perspective view of a housing of the spray canister dispenser.

Referring now to FIG. 7, there is shown a perspective view of the housing and threaded body of the spray canister dispenser. In the illustrated embodiment, the housing 1100 comprises a cavity 1400 that houses the threaded body 1320 of the adjustment mechanism. In the illustrated embodiment, the cavity 1400 is positioned centrally at an upper end 1110 of the housing 1100 such that the threaded body 1320 extends from a top side thereof. In this way the user can access and selectively rotate the threaded body 1320 via a knob 1330 extending from the threaded body to an exterior of the housing 1100. In the illustrated embodiment, the upper end of the cavity is substantially closed such that the threaded body 1320 cannot be rotated out of or removed from the cavity via the upper end thereof. In the illustrated embodiment, the threaded body 1320 is fixed in the cavity of housing 1100 such that it is adapted to only rotate and unable to move along an x or y axis independent of the housing.

Figure 8:
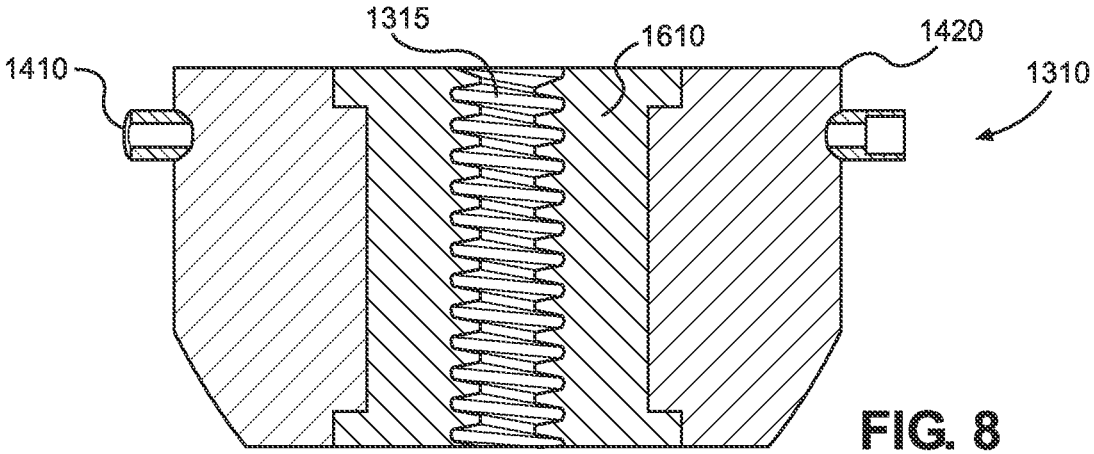
FIG. 8 shows a cross sectional view of a moveable plate of the spray canister dispenser.
Figure 9:
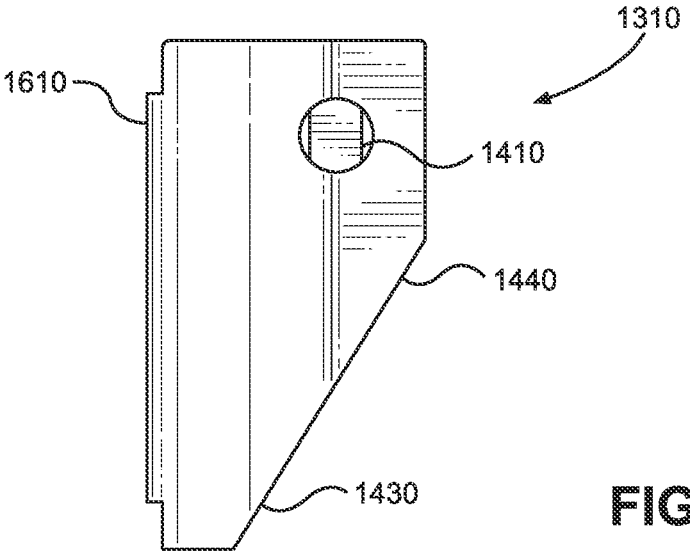
FIG. 9 shows a side view of a moveable plate of the spray canister dispenser.

Referring now to FIGS. 7-9, there is shown the perspective view of the housing and views of the moveable plate of the spray canister dispenser, respectively. In the illustrated embodiment, the moveable plate 1310 is secured to the housing 1100 via a track or interlocking joint disposed on mating faces (as seen on FIG. 4, 1600). The mating face of the moveable plate 1310 comprises a plate channel 1610 having matching threads 1315 that overlay the threaded body, thereby allowing the moveable plate 1310 to slide along a vertical axis of the housing as the knob 1330 is rotated. The plate channel 1610 is slidably received by the protruding lateral sides 1620 of the cavity of the housing forming an interlocking joint.

Referring now to FIGS. 8 and 9, the moveable plate 1310 comprises a pair of protrusions 1410 that secure through a pair of apertures (as seen in FIG. 3, 1405) disposed on the actuator assembly such that the actuator assembly is pivotally connected to the moveable plate 1310. In the illustrated embodiment, the protrusions 1410 and the apertures are positioned along the lateral sides of the upper ends 1420 of the moveable plate 1310 and actuator assembly, respectively. In this way, the actuator assembly and the moveable plate 1310 move independently of the housing. In the illustrated embodiment, the actuator assembly is not directly connected to the housing.

In the illustrated embodiment, an exterior face 1440 tapers inward from the upper end 1420 toward the lower end 1430 of the moveable plate 1310. In the illustrated embodiment, the exterior face 1440 is opposite the mating face of the moveable plate 1310. The tapered side provides additional space for the spray canister to be received within the interior of the housing, such that the moveable plate does not obstruct the canister placement therein.

Figure 10:
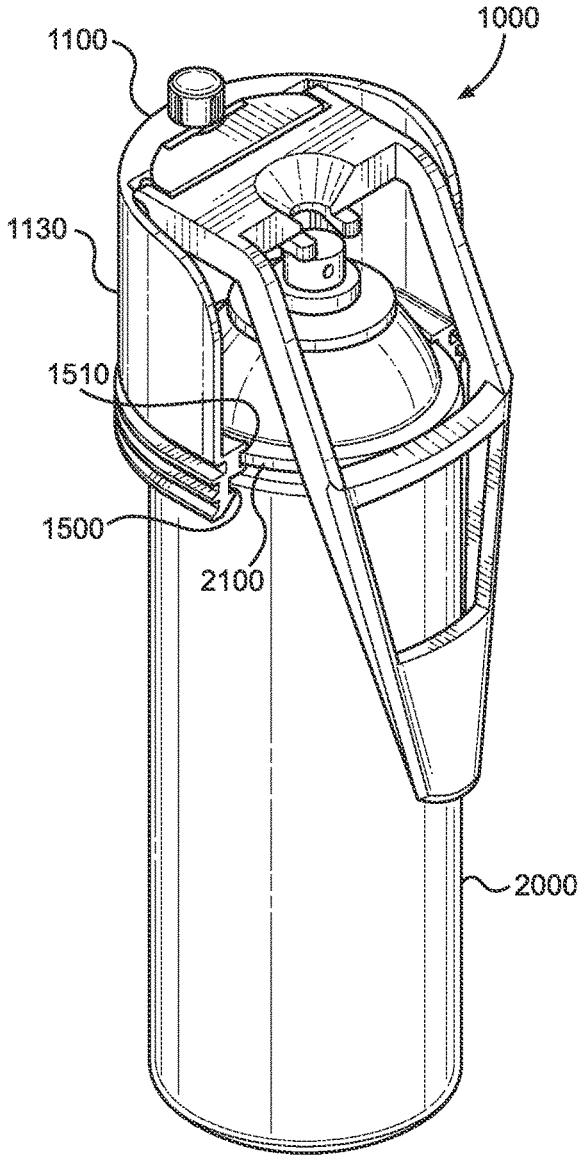
FIG. 10 shows a perspective view of an embodiment of the spray canister dispenser, wherein a second spray canister is mounted to the second channel.
Figure 11:
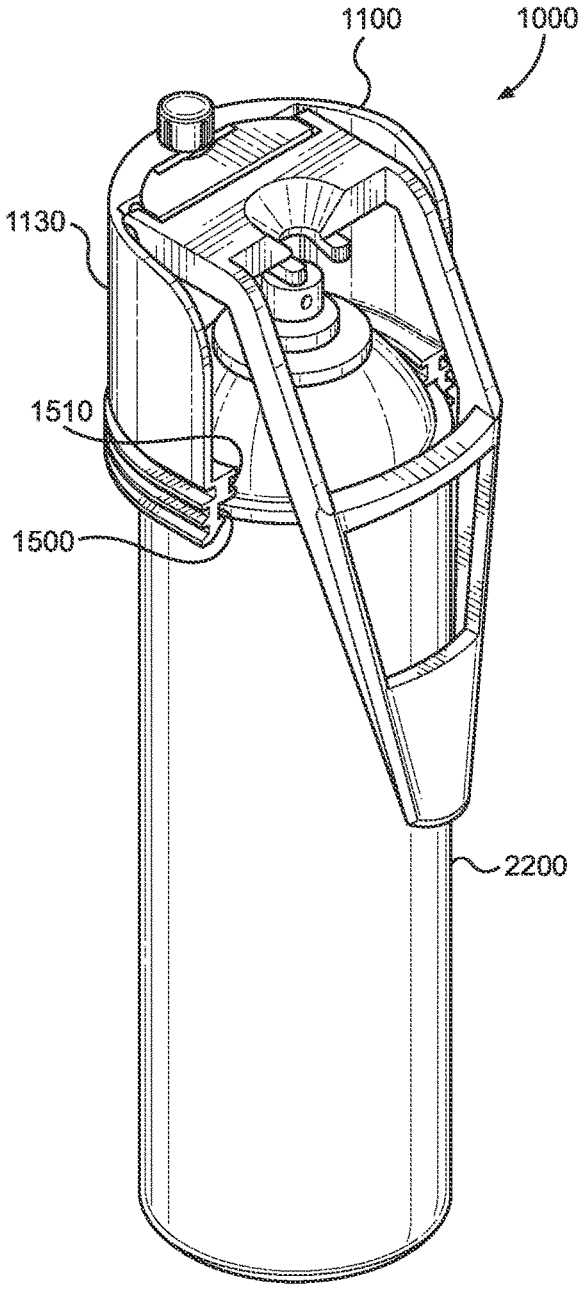
FIG. 11 shows a perspective view of an embodiment of the spray canister dispenser, wherein a spray canister is mounted to the first channel.

Referring now to FIGS. 10 and 11, there are shown perspective views of an embodiment of the spray canister dispenser, wherein a spray canister is mounted to the second channel and the first channel, respectively. In the illustrated embodiment, the spray canister dispenser 1000 is adapted to secure to a lip 2100 of a spray canister 2000. In some embodiments, the housing 1100 comprises a first channel 1500 disposed on an interior of the sidewall 1130 of the housing 1100, wherein the first channel is annular and adapted to align with a lip of the spray canister to selectively couple thereto. The channel 1500 extends around the entire sidewall. It is contemplated in alternate embodiments that the spray canister dispenser 1000 is adapted to removably receive the spray canister is any suitable manner, such as but not limited to, magnets, clips, latches, adhesive, among other similar fasteners.

In some embodiments, the spray canister dispenser 1000 includes a second channel 1510 having a different dimension than the first channel 1500 to allow the spray canister dispenser 1000 to removably mount to a second spray canister having a different lip dimension than that of the spray canister. This allows a user to use a single spray canister dispenser 1000 on various spray cans of different sizes and applications. In the illustrated embodiment, the first channel 1500 is positioned at the lower end or base of the housing 1100 and the second channel 1510 is disposed above the first channel.

Figure 13:
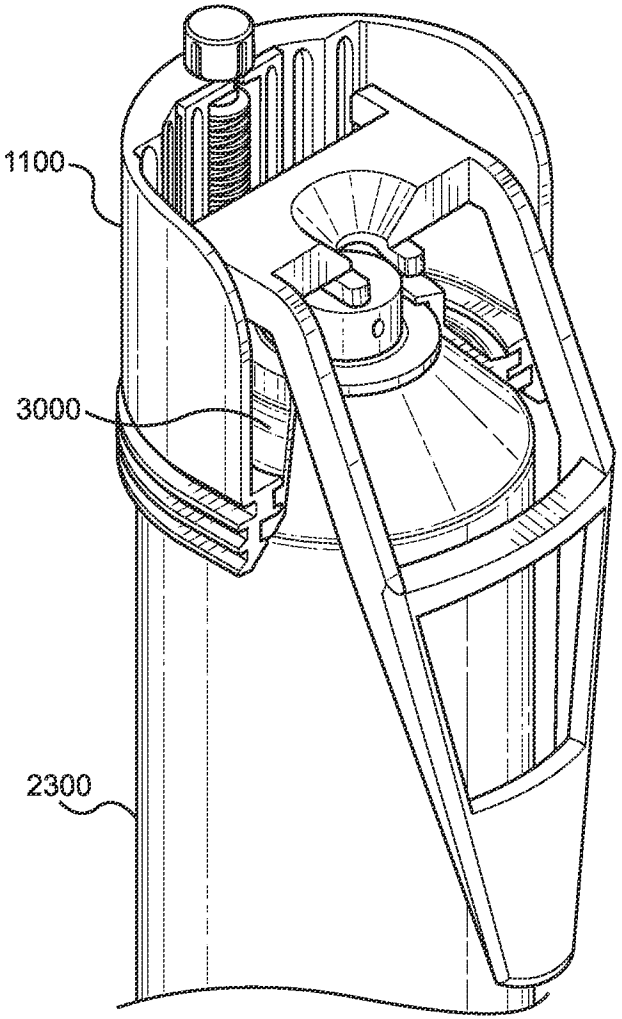
FIG. 13 shows a perspective view of an embodiment of the spray canister dispenser, wherein a spray canister is mounted to the first adapter.
Figure 12:
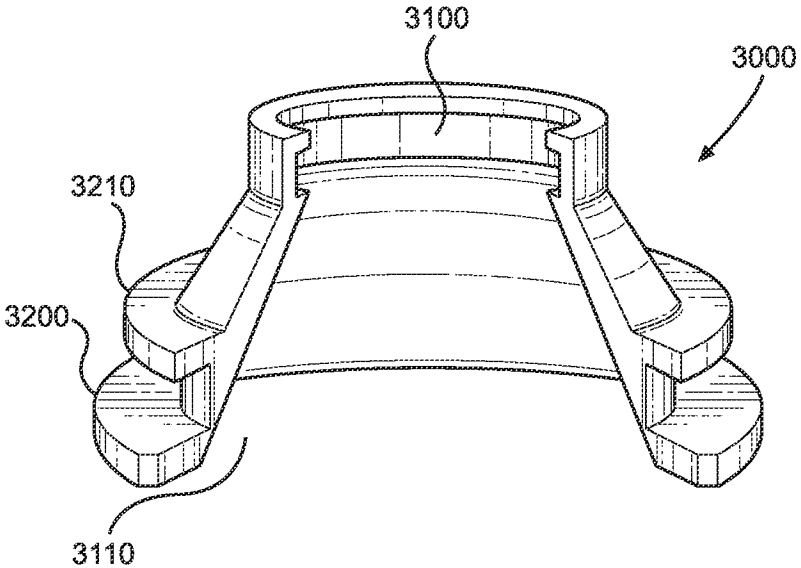
FIG. 12 shows a perspective view of a first adapter of the spray canister dispenser.

Referring now to FIGS. 12 and 13, there is shown a perspective view of a first adapter of the spray canister dispenser and a perspective view of an embodiment of the spray canister dispenser, wherein a spray canister is mounted to the first adapter, respectively. In some embodiments, the spray canister dispenser comprises an adapter configured to mount directly to a channel and secure around an upper end of a spray canister that lacks a lip to be secured within the channel. In the shown embodiment, the adapter 3000 comprises a cone shape having an open upper and lower end. The upper end comprises a groove 3100 adapted to receive an edge or smaller lip of a spray canister 2300. The smaller lip on the canister is too small to be received within the first or second channel, but the groove 3100 of the adapter is configured to secure to the smaller lip of the canister, wherein the adapter 3000 is configured to secure to the housing 1100.

The adapter 3000 comprises an open section 3100 extending between the upper and lower ends thereof. The open section 3100 comprises a substantially similar width to the opening in the sidewall of the housing. In the illustrated embodiment, the adapter 3000 comprises at least one adapter lip configured to align and fit within a channel of the housing. In some embodiments, the adapter comprises a first and second adapter lip 3200, 3210 configured to align and fit within the corresponding first and second channels of the housing 1100.

Figure 15:
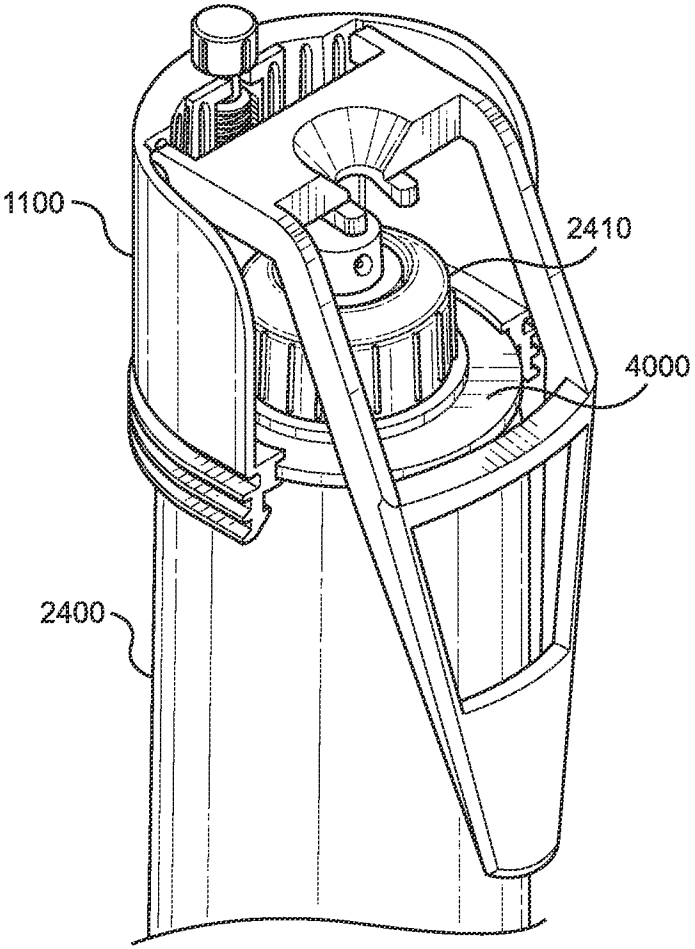
FIG. 15 shows a perspective view of an embodiment of the spray canister dispenser, wherein a spray canister is mounted to the second adapter.
Figure 14:
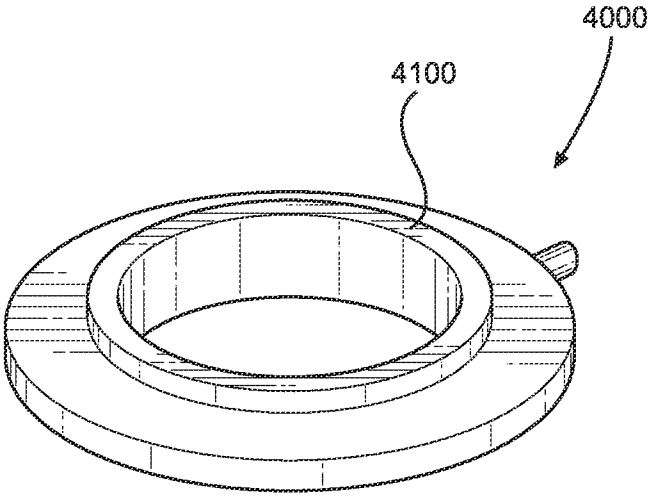
FIG. 14 shows a perspective view of a second adapter of the spray canister dispenser.

Referring now to FIGS. 14 and 15, there is shown a perspective view of a second adapter of the spray canister dispenser and a perspective view of an embodiment of the spray canister dispenser, wherein a spray canister is mounted to the second adapter, respectively. In the shown embodiment, the adapter 4000 comprises a ring shape configured to mount within the first or second channel of the housing 1100. A flange 4100 is disposed along the inner perimeter of the ring shape and configured to be seated below a cap 2410 or rim of the nozzle, such that the flange 4100 prevents the canister 2400 from falling through the center of the ring of the shown adapter 4000 when the adapter 4000 is secured to the housing. In some embodiments, the cap 2410 of the spray bottle is first removed and then the adapter is placed over the open end of the bottle 2400. The cap 2410 is then replaced and the adapter 4000 is secured to the housing 1100.

In other embodiments, the spray canister dispenser comprises a color indicator adapted to indicate to a user a color of the substance in the spray canister to which it is attached. In some embodiments, the color indicator is a wheel extending from an exterior of the spray canister dispenser, wherein a user can selectively rotate the wheel to display a color that most similarly corresponds to a paint spray can to which it is attached. In other embodiments, the color indicator provides for receiving a marker that has been colored with the substance from the paint spray canister to indicate to a user the color of the paint spray can to which it is attached. The marker is removable or washable to be reused with a different colored paint spray can.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A spray canister dispenser, comprising:

a housing configured to removably mount to an upper end of a spray canister;

wherein the spray canister includes a spray canister nozzle;

a first channel disposed on an interior sidewall of the housing adapted to align with a lip of the spray canister and selectively couple thereto;

an actuator assembly including a trigger handle and a top actuator operably connected to a moveable plate, wherein the actuator assembly transitions between a dispensing configuration and a resting configuration;

wherein the moveable plate configured to adjust a position of the top actuator relative to the spray canister nozzle;

wherein the moveable plate remains in a fixed position relative to the housing when the actuator assembly transitions between the dispensing and resting configuration;

wherein the trigger handle is adapted to be disposed on a forward side of the spray canister and the housing is adapted to be disposed on a rearward side of the spray canister; and wherein the dispensing configuration, the contents within the spray canister are dispensed through actuation of the spray canister nozzle at the forward side of the spray canister.

2. The spray canister dispenser of claim 1, further comprising an adjustment mechanism adapted to adjust a position of the top actuator relative to the spray canister nozzle and independently of the housing.

3. The spray canister dispenser of claim 2, wherein the adjustment mechanism comprises the moveable plate and a threaded body rotatably coupled between the housing and the moveable plate, such that as the threaded body is rotated, the moveable plate moves along a longitudinal axis thereof causing the actuator assembly to move therewith.

4. The spray canister dispenser of claim 3, wherein the threaded body extends from a top of the spray canister dispenser.

5. The spray canister dispenser of claim 1, further comprising a second channel having a different dimension than the first channel to allow the spray canister dispenser to removably mount to a second spray canister having a different dimension than that of the spray canister.

6. The spray canister dispenser of claim 5, wherein the first channel is positioned at a base of the housing and the second channel is disposed above the first channel.

7. The spray canister dispenser of claim 1, wherein the actuator assembly extends from an upper end of the housing and the top actuator is adapted to be positioned over the spray canister nozzle when the spray canister is coupled to the spray canister dispenser.

8. The spray canister dispenser of claim 7, wherein the trigger handle is actuated by moving towards a body of the spray canister when secured thereto, thereby causing the top actuator to depress and apply force to the spray canister nozzle.

9. The spray canister dispenser of claim 7, wherein the resting configuration, a gap is formed between the top actuator and the spray canister nozzle when mounted to the spray canister.

10. The spray canister dispenser of claim 1, wherein the trigger handle and the top actuator are formed of a monolithic structure.

11. The spray canister dispenser of claim 1, wherein the top actuator is substantially perpendicular to the trigger handle and comprises a pair of parallel rails and an opening disposed therebetween.

12. The spray canister dispenser of claim 1, wherein a length of the trigger handle is greater than a length of the housing.

13. The spray canister dispenser of claim 1, further comprising an aperture disposed within the trigger handle sized to allow for the substance to be dispensed therethrough.

14. The spray canister dispenser of claim 1, wherein the actuator assembly is adapted to move independently from the housing.

15. The spray canister dispenser of claim 12, wherein the actuator assembly is pivotally connected to the moveable plate.

16. A spray canister dispenser, comprising:

a housing configured to removably mount to an upper end of a spray canister;

wherein the spray canister includes a spray canister nozzle;

an actuator assembly including a trigger handle and an actuator operably connected to a moveable plate, wherein the actuator assembly transitions between a dispensing configuration and a resting configuration;

wherein the moveable plate is disposed within the housing;

an adjustment mechanism adapted to adjust a position of the actuator relative to the spray canister nozzle; and wherein the adjustment mechanism comprises the moveable plate and a threaded body, wherein the threaded body is rotatably coupled between the housing and the moveable plate and as the threaded body is rotated the moveable plate moves along a longitudinal axis thereof causing the actuator assembly to move therewith.

17. The spray canister dispenser of claim 16, wherein the trigger handle is adapted to be disposed on a forward side of the spray canister and the housing is adapted to be disposed on a rearward side of the spray canister, wherein the forward side of the spray canister indicates a direction a substance within the spray canister will be dispensed by the spray canister nozzle.

18. The spray canister dispenser of claim 1, wherein the top actuator directly contacts the spray canister nozzle.

19. The spray canister dispenser of claim 16, wherein the actuator directly contacts the spray canister nozzle.

20. The spray canister dispenser of claim 16, wherein the moveable plate remains in a fixed position relative to the housing when the actuator assembly transitions between the dispensing and resting configuration.

* * * * *